United States Patent [19]

Pearce et al.

[11] 4,123,042

[45] Oct. 31, 1978

[54] STEEL CONVERTER VESSEL TUYERE BLOCK CONSTRUCTION

[75] Inventors: Jai K. Pearce, Pittsburgh, Pa.; William Wells, Sydney, Canada

[73] Assignee: Pennsylvania Engineering Corporation, Pittsburgh, Pa.

[21] Appl. No.: 767,465

[22] Filed: Feb. 10, 1977

Related U.S. Application Data

[62] Division of Ser. No. 369,820, Jun. 14, 1973, Pat. No. 4,036,481.

[51] Int. Cl.[2] ..... C21C 5/48

[52] U.S. Cl. ..... 266/44; 266/224; 266/270; 266/47

[58] Field of Search ..... 75/51-60; 266/44, 47, 220-222, 224, 265-270

[56] References Cited

U.S. PATENT DOCUMENTS

| | | | |
|---|---|---|---|
| Re. 25,528 | 3/1964 | Hall | 266/265 |
| 405,392 | 6/1889 | Bertrand | 75/60 |
| 3,330,645 | 7/1967 | Moustier et al. | 266/268 X |
| 3,397,878 | 8/1968 | Holmes et al. | 266/268 |
| 3,829,073 | 8/1974 | Courard | 266/268 |
| 4,007,035 | 2/1977 | Smith | 75/60 |
| 4,023,781 | 5/1977 | Fritz et al. | 266/44 |

FOREIGN PATENT DOCUMENTS

| | | | |
|---|---|---|---|
| 776,428 | 12/1971 | Belgium | 266/47 |
| 785,810 | 11/1957 | United Kingdom | 266/47 |
| 905,863 | 9/1962 | United Kingdom | 266/47 |

*Primary Examiner*—Roy Lake
*Assistant Examiner*—Paul A. Bell
*Attorney, Agent, or Firm*—Fred Wiviott

[57] ABSTRACT

A tuyere assembly for use in metallurgical vessels includes a tubular metallic tuyere housing which is cast in a book of refractory material. When the tuyere block is installed in a metallurgical vessel, a tuyere is inserted within the tubular tuyere housing and the space between the tuyere assembly and the housing sealed with a suitable refractory material. After a significant portion of the tuyere assembly has burned away during metallurgical operations, the tuyere may be withdrawn from the tuyere housing and a new tuyere substituted. Any refractory lining which has burned away in the vicinity of the new tuyere may be built up with a chemically bonded gunning mixture which sets to form a dense refractory material around the tuyere assembly.

4 Claims, 11 Drawing Figures

STEEL CONVERTER VESSEL TUYERE BLOCK CONSTRUCTION

This is a division of application Ser. No. 369,820, filed June 14, 1973, now U.S. Pat. No. 4,036,481.

BACKGROUND OF THE INVENTION

In conventional bottom or side blown steel metallurgical vessels, tuyeres are normally located below the bath level for injecting gases such as argon, oxygen, nitrogen, etc. into the molten metal. One recently developed type of tuyere comprises concentric pipes wherein oxygen is normally injected through the inner pipe and a hydrocarbon fluid, such as propane, is injected through the outer pipe as a shielding gas to prolong tuyere and refractory life. In spite of the use of shielding fluids, such tuyeres and their surrounding refractory lining are generally burned away at a rate faster than the refractory vessel lining. In bottom blown vessels, therefore, it is often necessary to replace the vessel bottom several times during the life of the refractory lining of the vessel itself. Similarly, side blown vessels the more rapid deterioration of tuyeres and adjacent refractory lining generally necessitates shutdown for a tuyere replacement and repairs at a point prior to the end of the useful life of the refractory lining of the furnace itself.

SUMMARY OF THE INVENTION

It is a primary object of the invention to provide a new and improved tuyere assembly for metallurgical vessels.

Another object of the present invention is to provide a tuyere arrangement for metallurgical vessels which is easily and quickly replaced.

Another object of the invention is to provide a tuyere arrangement for use in side or bottom blown metallurgical vessels which may be replaced without the necessity of replacing the adjacent vessel refractory.

How the foregoing and other more specific objects are achieved will be evident in the description of embodiments of the invention which will be set forth shortly hereinafter in reference to the drawings.

Briefly stated, the invention comprises a tuyere assembly which includes a hollow tubular metallic tuyere housing which is cast within a block of refractory material and a tuyere insertable in the tuyere housing and secured in place by a suitable refractory grouting mixture. One or more tuyere assemblies may be installed in a metallurgical vessel bottom or side wall below the melt surface for injecting various gases during the metallurgical process. When tuyere replacement is required, the old tuyere assembly is withdrawn from the tuyere housing and a new tuyere assembly inserted and grouted in place. The vessel or furnace refractory in the vicinity of the tuyeres may be built up by applying a curable refractory gunning mixture which, after setting, permits the steel conversion process to be continued. Alternatively, a plurality of additional plugged tuyere housings may be employed. In the latter embodiment, the plugged housings are opened and a tuyere inserted after the refractory around the original tuyeres are burned back to a predetermined degree. In addition, the original tuyeres are removed and their housings blocked with refractory.

DESCRIPTION OF A PREFERRED EMBODIMENT

Figure 1:
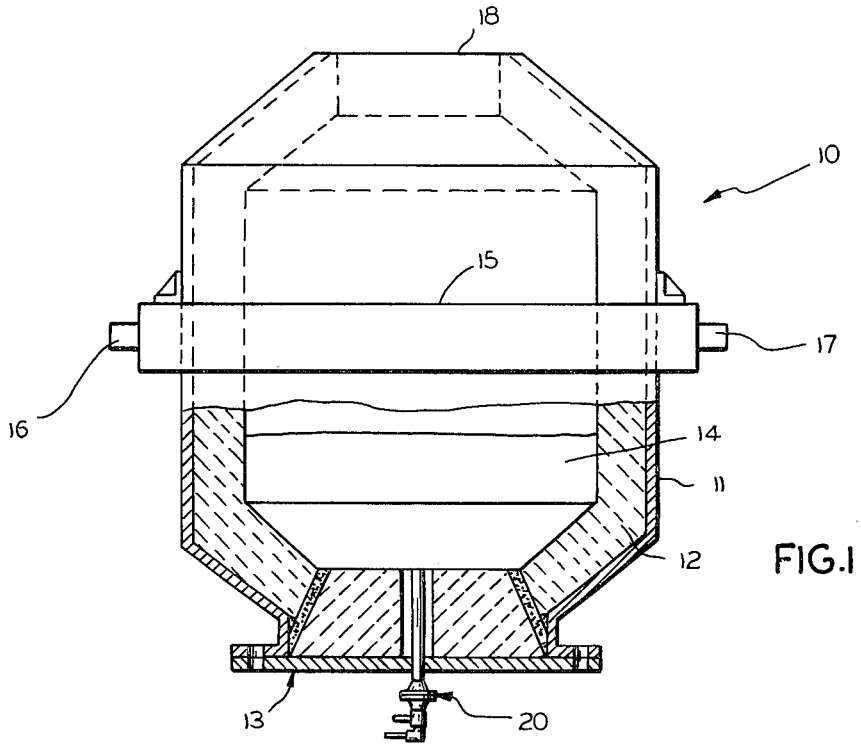
FIG. 1 is a schematic elevational view of a converter vessel, partly in section, in which the tuyere assembly according to the invention may be employed.

FIG. 1 schematically illustrates a metallurgical vessel 10 of the bottom blown type which is one example of an apparatus with which the present invention may be employed. Vessel 10 generally includes an outer metallic shell 11 which is lined interiorly with refractory material 12. The vessel 10 may include a refractory bottom plug 13 which closes the vessel bottom for containing a bath of molten metal 14. A converter vessel 10 such as is illustrated in FIG. 1 is usually mounted for being tilted on a trunnion ring 15 from which trunnion pins 16 and 17 extend, and which are rotatably supported by means not shown to facilitate charging the vessel 10 with hot metal and scrap and emptying it through a mouth opening 18.

A plurality of tuyere assemblies 20 according to the present invention may extend through the bottom insert 13 of the vessel 10 with their inner ends below the level of bath 14. As will be described more fully below, each of the tuyere assemblies 20 generally include a first passage for delivery of oxygen during the main oxygen blow and a second passage surrounding the first passage for injecting a shielding fluid such as propane, hydrocarbon gas, light oil, natural gas, and the like. As those skilled in the art appreciate, the shielding fluid prolongs the refractory and tuyere life. In addition to oxygen and propane, other process gases such as argon and nitrogen may be blown through one or both of the tuyere passages and finely divided materials such as lime, limestone, iron oxide, fluorspar, burnt lime and other materials may be entrained in the gas stream to provide the desired metallurgical reactions.

Each of the tuyere assemblies 20 are identical and accordingly only one will be discussed in detail for the sake of brevity.

Figure 2:
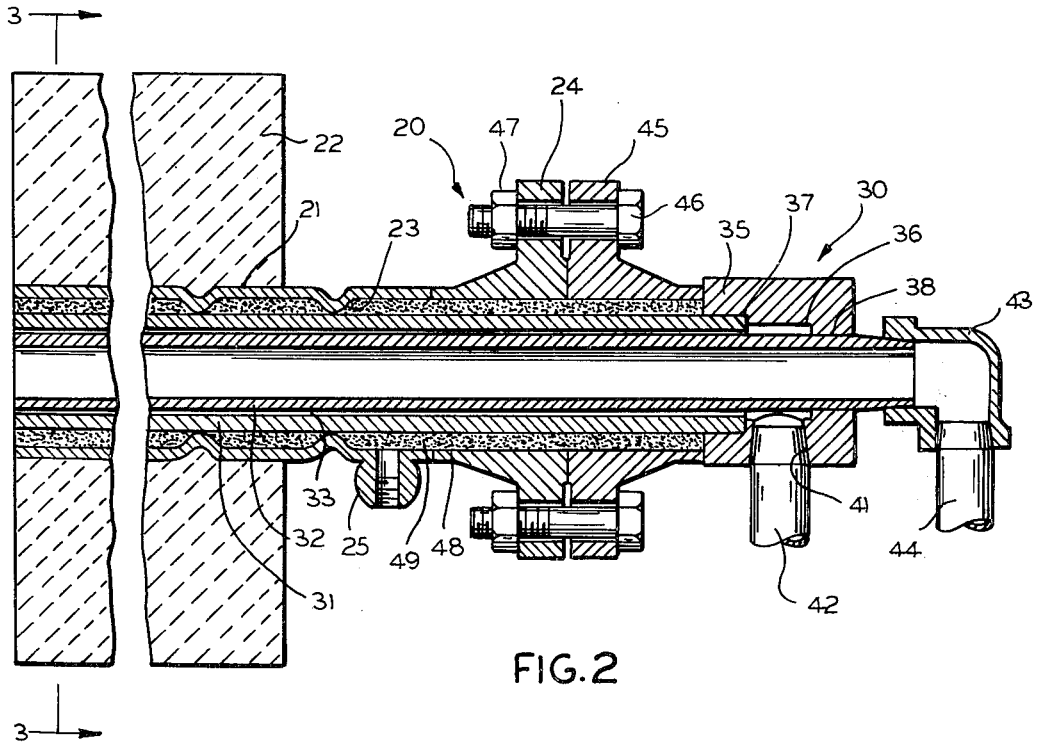
FIG. 2 is a longitudinal sectional view of a tuyere assembly according to the invention.
Figure 3:
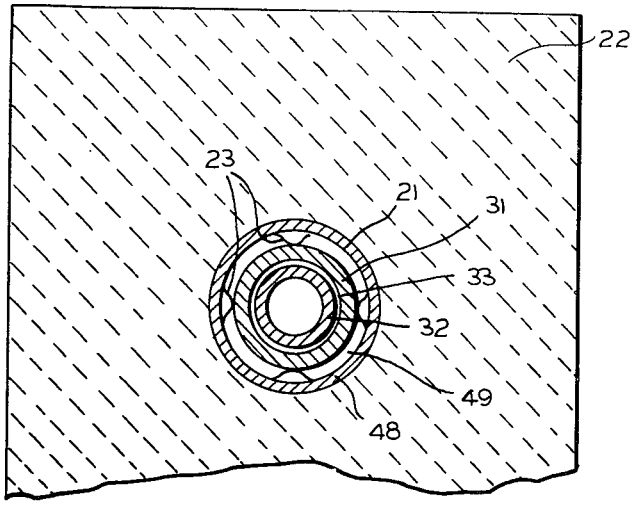
FIG. 3 is an end view of the tuyere assembly taken along line 3—3 of FIG. 2.

Referring now to FIGS. 2 and 3, a tuyere assembly 20 is shown to include a tubular housing 21 suitable secured within a refractory block or body 22. The tuyere housing 21 may take any convenient form such as a hollow tubular member formed of any suitable metallic material, such as steel. The housing 21 is preferably embedded within the body 22 in any suitable manner.

For example, the housing 21 may be positioned within a mold (not shown) which is then filled with a suitable refractory material, such as a chemically bonded magnesite mixture. It is preferable to achieve maximum density by ramming, vibration, pressing or the like. If the mix is not self curing, a curing step may be desirable.

The tuyere housing 21 is provided with a plurality of spacers 23 along its inner surface which may comprise weld beads, fins or peening impressions made in the tuyere housing 21. The protrusions are circumferentially and axially spaced along the interior of the tubular housing 21 for a purpose to be explained hereinafter. As is seen in FIG. 2, the tubular housing 21 extends outwardly from one end of the body 22 and terminates in a radially outwardly extending flange portion 24. Intermediate the flange 24 and the body 22 is an internally threaded, hollow nipple 25 affixed to the housing 21 and communicating with the interior of housing 21 whose purpose will be explained hereinbelow.

A tuyere 30 which may be employed with the present invention is shown in FIGS. 2 and 3 to include two tuyere pipes 31 and 32 arranged in a coaxial relation. The inner diameter of the outer tuyere pipe 31 is larger than the outer diameter of the inner tuyere pipe 32 to define an annular gap or passage 33 therebetween. The tuyere pipes 31 and 32 are mounted in spaced apart relation by means of a hollow, generally tubular tuyere pipe support body 35. As seen in FIG. 2, the body 35 is formed with a cylindrical bore 36 intermediate its ends, and a counterbore 37 is formed in one end of body 35 for fixedly receiving the end of the outer tuyere pipe 31. At the opposite end of the body 35, a concentric, smaller diameter opening 38 is formed for fixedly receiving the inner tuyere pipe 32. In this manner, the tuyere pipes 31 and 32 are affixed in spaced relation to form the gap 33. Suitable spacing means such as fins, weld beads or peening impressions may also be employed to space pipes 31 and 32. An internally threaded aperture 41 is formed in body 35 which extends through to communicate with bore 36 which in turn communicates with annular gap 33 between the outer tuyere pipe 31 and inner pipe 32. The aperture 41 threadably receives a pipe 42 which may be connected to a source of pressurized gas for injection into the converter vessel. Similarly, a hollow fitting 43 is affixed to the extension of innermost tuyere pipe 32 from the end of housing 35, and the fitting 43 is also adapted to receive the pipe 44 for supplying gas under pressure to the interior of the inner pipe 32. In addition, a radially outwardly extending flange 45 is formed on the body 35 adjacent the opening 37.

The tuyere 30 may be placed within tuyere housing 21 by sliding the tuyere pipes 31 and 32 into the interior of tuyere housing 21 such that the outer surface of the outer tuyere pipe 31 contacts the protrusions 23 of the housing 21. The outer tuyere pipe 31 is thus maintained in a concentrically spaced relationship relative to the interior of tuyere housing 21. When the tuyere 30 is positioned within housing 21, flanges 45 and 24 are in registry and may be suitably secured by means such as bolts 46 and nuts 47. As seen in FIG. 2 an annular gap 48 exists between the outer tuyere pipe 31 and the interior of the tuyere housing 21 and communicates with the nipple 25. After tuyere 30 has been bolted to flange 24, and a pressurized source of a suitable grouting mixture such as heat setting magnesite grout is coupled to nipple 25 for being pumped therethrough to fill the annular space 48 between the tuyere housing 21 and tuyere pipe 31.

Figure 4:
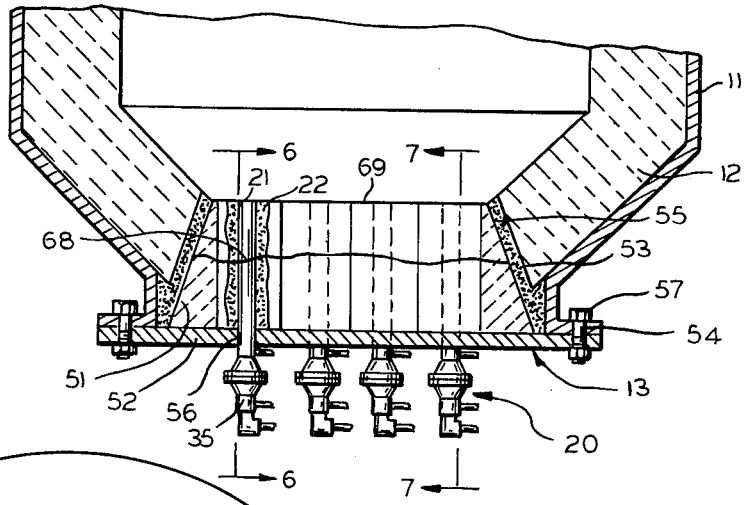
FIG. 4 is a vertical sectional view of a portion of a bottom blown converter vessel incorporating the tuyere assemblies according to the invention.

In the embodiment of the invention shown in FIGS. 1 and 4 the bottom assembly 13 includes a plurality of tuyere assemblies 20 disposed in spaced apart relation with the interstices between the refractory tuyere bodies 22 filled with suitable refractory material which may take any convenient form such as refractory shapes 51, refractory mortar or a combination of the two. For example, the refractory shapes 51 may comprise any suitable refractory material such as tar bonded dolomite, a chemically bonded ram mix, dolomite-magnesite or magnesite. The tuyere assemblies 20 and refractory shapes 51 are arranged and supported on a bottom plate 52. A suitable refractory mortar 53 is used to seal the joint between the vessel lining 12 and the refractory shapes 51 of the bottom assembly 13. In addition, the bottom plate 52 is securely fastened to a mating flange 54 on the vessel bottom by suitable clamping means (not shown).

Figure 5:
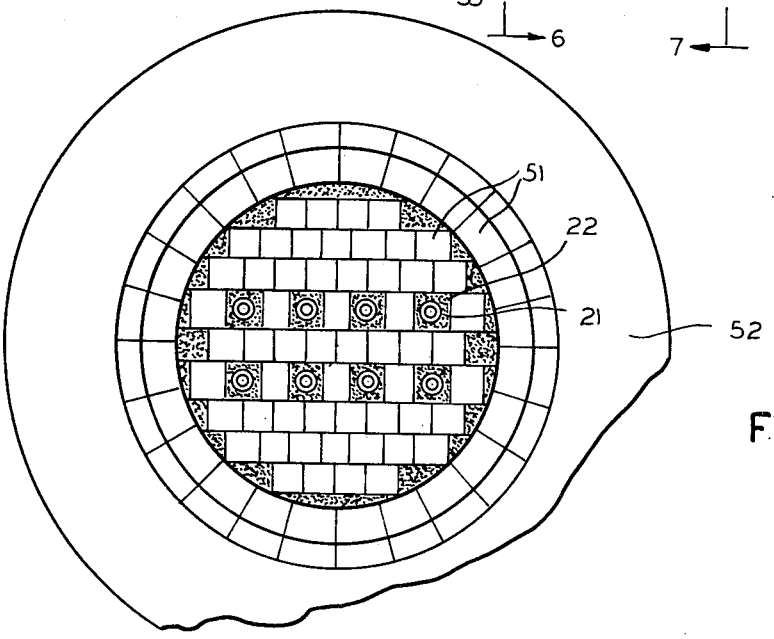
FIG. 5 is a plan view of a bottom insert removed from the vessel of FIG. 4.

In construction of the vessel bottom insert 13, a plurality of tuyere assemblies 20 may be arranged with the blocks 22 abutting plate 52 and the tuyere bodies 35 and the end of tuyere housings 21 extending through suitably arranged apertures 56 as is shown in FIGS. 4 and 5. The blocks 22 may be arranged in whatever manner may be required to achieve the desired tuyere array. For example, in the illustrated embodiment, the tuyeres are arranged in a generally rectangular, spaced apart relation with the tuyere assemblies 21 extending generally vertically, although it will be understood that many arrangements of tuyere patterns are possible. The tuyere blocks and interposed refractory shapes may be joined in any suitable manner such as by magnesite mortar, chrome magnesite mortar, tar-magnesite or other suitable high temperature refractory mortar. The juxtaposed refractory bricks are preferably arranged in such a manner as to form a generally conical, axially converging insert 13 which may have peripheral surface irregularities due to the prism shape and square corners of the refractory shapes 51 from which it is fabricated. After insert 13 has been formed, its conical peripheral surface may be covered with mortar 53 of the type discussed above and then forced up into a generally conforming mating opening 55 in the bottom of the converter vessel 10. The internal surface of opening 55 may be irregular or smooth depending on the manner in which the refractory lining 12 of the vessel is made. When the insert is forced into place, the soft mortar 53 ramming mixture flows into any cavities at the interface of the insert 13 and opening 55 so as to effect a bond and a seal. The base plate 52 may then be fastened to vessel 10 in any suitable manner such as bolts 57 which extend through suitable openings in said plate and an annular flange 54 which is integral with the metal vessel shell 11. It will be understood that the thickness of insert 13 is not critical within limits nor is the external size of the conical insert critical because the mortar 53 will make up for any dimensional variations in the insert.

It will also be apparent that the bottom insert 13 could also be molded without the use of refractory shapes 51. For example, the tuyere blocks 22 could be to bottom plate 52 in a predetermined array and the spaces between blocks 22 filled with a suitable refractory such as tar-dolomite or refractory mortar mixture which could then be cured and hardened to form a monolithic cast bottom insert containing the refractory blocks 22 and tuyere housings 21.

Figure 6:
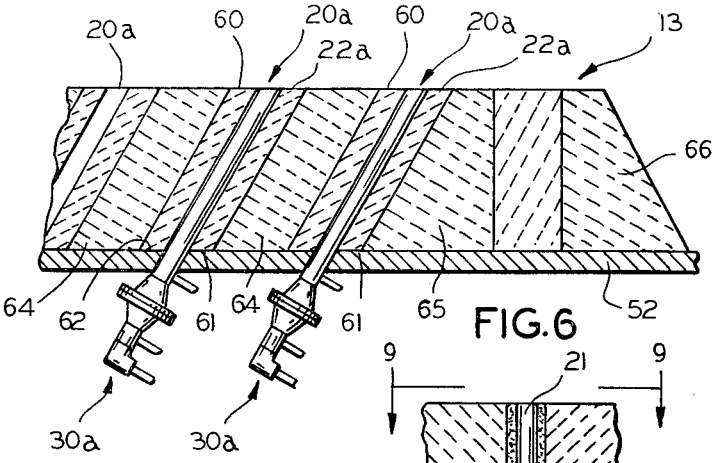
FIG. 6 is a view taken along line 6—6 of FIG. 4.
Figure 7:
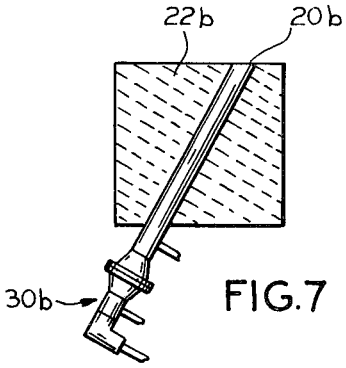
FIG. 7 is a view taken along line 7—7 of FIG. 4.

It will be appreciated that the alternate configurations shown in FIGS. 6 and 7 may be effected by providing molds having an appropriate shape. In constructing a vessel bottom insert 13, it may be desirable to use a combination of angular and vertically aligned tuyere assemblies, or other mixed arrangements may be desired.

When a bottom insert 13 has been fabricated with the appropriate number of tuyere housings 21 in accordance with any one of the embodiments discussed hereinabove, the tuyeres 30 may be inserted and grouted in place as previously described. Installation of tuyeres 30 may take place before, or after installing the bottom insert 13 into vessel 10.

An alternate embodiment of the invention is shown in FIG. 6 wherein the tuyere assemblies 20*a* are inclined relative to the longitudinal axis of the vessel. Here the upper and lower faces 60 and 61 respectively of each refractory block 22*a* are substantially parallel to each other and formed at an angle relative to the longitudinal axis of said block. As a result, when the surface 62 of blocks 22*a* are positioned on plate 52 the tuyere assemblies 20*a* are inclined at the desired angle, which is normally about 3° – 15° relative to the vertical. In the illustrated embodiment, suitable special refractory shapes 64 which have inclined surfaces similar to those of blocks 22*a* and are positioned therebetween. Positioned adjacent the endmost of the assemblies 20*a* are a regular refractory shape 65 and a skew-back refractory shape 66. A plurality of skew-backs similar to shape 66 defines the periphery of the bottom insert 30*a* while generally rectangular shapes similar to shapes 66 may be disposed between rows of tuyere assemblies 20*a* and between each row and the peripheral skew-backs 66. A suitable refractory mortar such as those enumerated above may be employed to secure the refractories in a unitary assembly.

According to another embodiment of the invention set forth in FIG. 7 the tuyere block 22*b* is generally rectangular in horizontal and vertical cross section with the tuyere housing cast therein at the desired angle.

Figure 8:
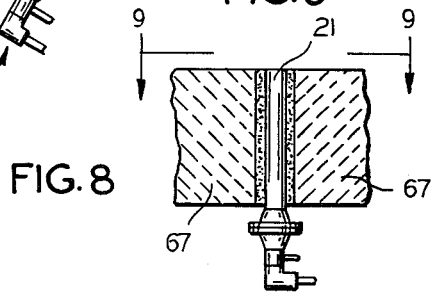
FIG. 8 is an elevational sectional view of an alternate tuyere embodiment according to the invention.
Figure 9:
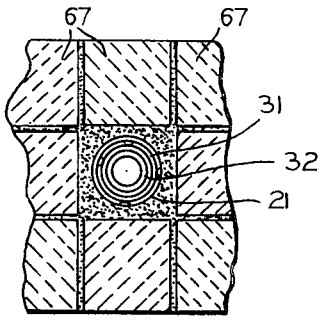
FIG. 9 is an enlarged view taken along line 9—9 of FIG. 8.

A further embodiment of the invention is shown in FIGS. 8 and 9 wherein a plurality of refractory shapes 67 are disposed in closely surrounding relation to the tuyere housing 21 with the inerstices filled with a suitable refractory bonding material or mortar such as those discussed above. This embodiment also illustrates that the tuyere housings 21 may be embedded directly within the bottom refractory without the use of tuyere blocks. It will be appreciated that instead of the use of refractory shapes 67, the tuyere housings 21 may be cast directly in a monolithic bottom assembly.

Normally, during the treatment of a plurality of heats in metallurgical vessels such as vessel 10 illustrated in FIG. 1, the refractory material which forms the bottom insert 13 is consumed at a substantially faster rate than that of the vessel side walls. As a result, in a typical vessel campaign the vessel side wall refractory will outlast several bottoms. The tuyere assembly 20 according to the present invention may be employed to prolong the life of a vessel bottom.

In operation of the converter vessel 10, a metal charge 14 which may include molten pig iron and/or steel scrap, is placed in the vessel and oxygen and various other gases injected through the tuyeres 30 to effect the desired metallurgical reactions. For a more complete description of such metallurgical processes, reference is made to copending application Ser. No. 229,958, filed Feb. 2, 1972, now U.S. Pat. No. 3,920,447. Assume for example with reference to FIG. 4, that after a number of heats, the bottom refractory and tuyere assemblies 20 burn to the level indicated by the line 68 wherein the bottom would normally require replacement. The tuyere assemblies 20 permit replacement of the tuyeres 30. Toward this end, the various gas pipes leading to the tuyeres 30 are disconnected and the latter are pulled from the tuyere housings 21 by any suitable means such as a block and tackle. This will leave the tuyere housings 21 and blocks 22 in place to the extent which they have not been burned away. Next, by means of a hand drill or other suitable device, the grout material which had filled the annular space 48 between the outer tuyere pipe 31 and the tuyere housing 21 is removed, and a new tuyere 30 inserted into the tuyere housing 21. The annular space 48 is then regrouted by injecting a suitable grout through nipple 25 as discussed with respect to FIG. 2. This replacement will leave the new tuyeres 30 extending upward to the original level of the refractory bottom 34 as designated by the dashed line 69. The exposed area surrounding the tuyeres 30 between the level 68 to which the bottom refractory has been burned down and the original refractory level 61 is filled by inserting a fast setting magnesite gunning mix such as a phosphate or chromate bonded magnesite material containing 90% MgO. This minimizes replacing the vessel bottom 13 and can be accomplished in a relatively short time. The tuyere assemblies 20 also permit replacement of individual tuyeres should they burn back or become plugged prior to the time when a general tuyere replacement becomes necessary.

Figure 10:
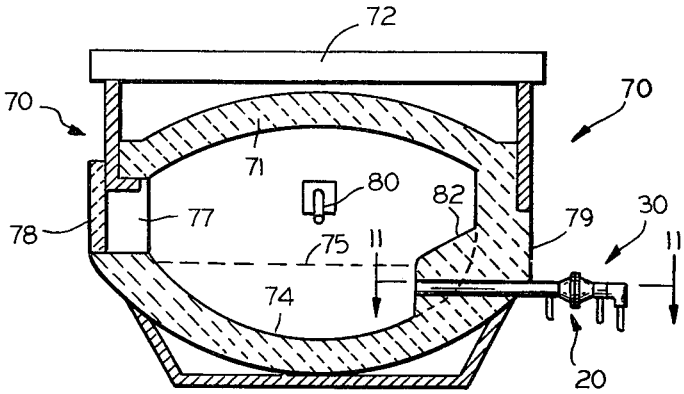
FIG. 10 is a side elevational sectional view of an open hearth furnace employing the tuyere assemblies according to the invention.
Figure 11:
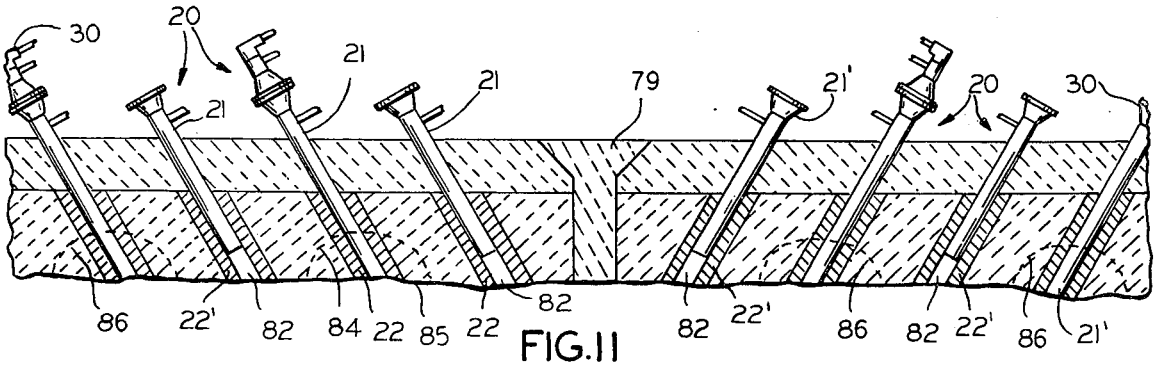
FIG. 11 is a view taken along line 11—11 of FIG. 10.

FIGS. 10 and 11 illustrate the application of the tuyere assemblies according to the invention to an open hearth furnace 70 which generally includes a refractory lining 71 surrounded by a supporting framework generally designated by the numeral 72. The refractory lining 71 generally defines a vessel having a shallow hearth 74 for containing a bath of molten metal 75. A plurality of charging openings 77 are formed along one side of the furnace 70 and each is provided with a charging door 78 which may normally be raised and lowered when desired in any suitable manner. A burner 80 may extend through one or both ends of the vessel 70 in a manner well known in the art.

A plurality of tuyere asemblies 20 may extend through any wall of furnace 70 with the inner ends of tuyeres 30 positioned below the level of the bath 75. As previously described, the tuyeres 30 may include two concentric pipes 31 and 32 wherein a first process gas, such as oxygen may be blown through the inner tuyere pipe 32, and a shielding fluid, such as light oil, hydrocarbon gas, manufactured gas or propane may be blown through the gap 33 between inner pipe 32 and outer pipe 31.

The tuyere assemblies 20 may be mounted in the refractory lining 71 of the furnace 70 in any suitable manner analogous to that discussed with respect to the embodiment of FIG. 1. For example the refractory in the furnace area into which the tuyere assemblies 20 are to be installed is suitably built up as indicated by reference numeral 81. This refractory structure 81 may be formed in any suitable manner such as refractory shapes or by a chemically bonded ramming mix such as a phosphate or chromate bonded magnesite material containing about 90% MgO. Initially this refractory is built up to the level of the tuyeres, in which case the tuyere blocks 22 containing housings 21 are placed in position and the build up completed. It will be understood that the refractory material could be built up directly around the tuyere housings in which case the tuyere blocks would not be employed. If the tuyere assemblies 20 are to be installed in existing open hearth furnaces the side wall refractory is broken away to permit placement of the tuyere assemblies 20 and said sidewall is rebuilt in the indicated manner.

The number of tuyeres required in the furnace 70 will be dictated by the process requirements which need not be discussed here. In the illustrated embodiment, four tuyere assemblies 20 are shown as an example, with two being located on each side of the top holes. Each includes a tuyere housing 21 and a tuyere 30. In addition any number of additional tuyere housings 21' are affixed into the side of the refractory 71 and on the opposite side of the top hole 79 and are disbursed in any suitable manner among the active tuyeres 30. The tuyere housings 20 and 21' may be affixed directly into the refractory 71 or into tuyere blocks 22 and 22' respectively. Also the housings 21' are empty except for refractory 82 which fills their inner ends while the housings 21 of course contain tuyeres 30.

As previously discussed, the life of the furnace lining 71 remote from the vicinity of the injection point of the tuyeres 30 generally exceeds the life of the lining 71 around the tuyeres 30. For example, during steel making operations, one or more of the tuyeres 30, their associated tuyere assemblies 20 and the surrounding lining 71 may burn down to a level indicated by dashed line 86 wherein replacement becomes desirable. Those tuyeres 30 requiring replacement may be removed and the opening in their tuyere housings 21 plugged with a suitable refractory mortar. An equal number of tuyere housings 21' are then opened by drilling through the refractory mortar plug 82 to permit insertion of a new tuyere 30 in each, in a manner previously discussed with respect to the converter vessel 10 of FIG. 1. The gap between the tuyere 30 and the tuyere housing 22' would of course be filled with a refractory grout in the manner previously discussed.

Alternatively after any tuyere assembly 20 has burned down to a point requiring replacement, the tuyere 30 may be removed as previously discussed and new tuyeres inserted and installed in the remaining portions of the tuyere housings 21. These new tuyeres would extend out to the original surface 85 of the refractory lining 71 and the surrounding area is then filled with a suitable, hot setting refractory gunning mixture to the level of the original refractory surface. Again, the replacement operation may be accomplished in a relatively short time thus eliminating costly shutdown time of the furnace, although it will be appreciated that sufficient time must be provided to allow the refractory to cure. In this manner, the life of the refractory lining 71 of the furnace in the area of the tuyere assemblies 20 and 20' may be adjusted to more closely approximate the life of the refractory lining 71 of the furnace 70. It will also be appreciated that by selectively precasting the tuyere blocks 22 at various angles, when they are installed in the refractory wall 71 of the furnace 70, various injection angles may be obtained for optimum furnace performance.

Those skilled in the art will appreciate that the use of additional empty tuyere housings 21 which are blocked with refractory mortar is not limited to the open hearth vessel shown in FIGS. 10 and 11 but may also be employed with the vessel 10 illustrated in FIG. 1. These tuyere housings would be drilled to remove refractory and a new tuyere inserted while the old tuyere housing is plugged and the surrounding refractory replaced.

While only a few embodiments of the invention have been described, it will be apparent to those skilled in the art that many variations of the invention are possible. For example, while tuyeres having a single outer pipe for the delivery of hydrocarbon shielding fluid has been shown and described, it will be appreciated that the shielding fluid may be delivered through one or more pipes surrounding the inner tuyere pipe. Accordingly, the scope of the invention is to be taken from an interpretation of the claims which follow. In addition, the tuyere mounting assembly may be employed in other types of metallurgical vessels than those shown, such as electric arc furnaces, holding furnaces, induction furnaces, Kaldo type vessels and the like.

We claim:

1. The method comprising the steps of:

casting a plurality of tubular tuyere housings in separate blocks of refractory material with one end of each said housing extending from the end of its associated block, installing said plurality of blocks in the lower level of a refractory lined metallurgical vessel with said tuyere housings extending generally toward the interior thereof and the one end of said housings being exposed on the exterior of said vessel, installing a first tuyere in at least a first one of said housings, securing said first tuyere to the exposed end of said first housing, plugging the remaining housings with refractory material, containing a quantity of molten metal in said vessel, injecting oxygen containing gases under pressure into said vessel through said tuyere and beneath the level of said metal causing said tuyere to burn down to a predetermined length, removing said burned down tuyere from said first housing, plugging the housing from which said burned tuyere was removed by inserting refractory material through the exposed end thereof, opening a second one of said housings, installing a second tuyere in said opened housing, securing said second tuyere to the exposed end of said second housing, and placing refractory around the inner end of said second tuyere so that the refractory lining of the vessel in the area surrounding said second tuyere has substantially its initial thickness.

2. The method set forth in claim 1 wherein said first and second tubular housings are larger than said first and second tuyeres whereby gaps are defined therebetween, and inserting a curable refractory material into said gaps.

3. A method of constructing and using a bottom insert for a refractory lined metallurgical vessel comprising the steps of:

casting a tubular tuyere housing in a block of refractory material, supporting said blocks on a bottom plate with said tuyere housing extending through said plate, providing a layer of refractory material on one surface of said bottom plate and around said block such that said tuyere housing defines a passage extending through said bottom plate and said layer of refractory material, and sealing the interstices between said block and said refractory material with a curable refractory, extending a tuyere into said housing from the opposite side of said plate, said tubular tuyere housing being larger than said tuyere, securing said tuyere to the end of said tuyere housing disposed on the opposite side of said plate, and in spaced relation relative to said housing to form a gap therebetween, and inserting a curable refractory material into said gap, inserting said insert in the lower portion of a metallurgical vessel, containing a quantity of molten metal in said vessel, injecting oxygen containing gases under pressure into said vessel through said tuyere and beneath the level of said metal causing said tuyere to burn down to a predetermined length, removing said burned down tuyere from said housing and through the said one end thereof, inserting a second tuyere into said housing and securing the same to the said one end of said housing, inserting a refractory material into the gap between said tuyere housing and said second tuyere, and applying a refractory material to the refractory lining of said vessel and in surrounding relation to the inner end of the tuyere housing to substantially reestabilsh the original thickness of said lining.

4. The method comprising the steps of:

installing at least one tuyere housing in the lower level of a refractory lined metallurgical vessel with one end extending outwardly of said vessel and the other end adjacent an internal surface thereof, extending a tuyere through said housing and affixing one end to the one end of said housing, said tuyere housing being larger in transverse cross-sectional area than said tuyere whereby a gap is defined therebetween, disposing a refractory material in the gap between said tuyere and said tuyere housing, surrounding said housing with refractory material, containing a quantity of molten metal in said vessel, injecting oxygen containing gases under pressure into said vessel through said tuyere and beneath the level of said metal causing said tuyere to burn down to a predetermined length, removing said burned down tuyere from said housing and through the one end thereof, inserting a second tuyere into said housing and securing the same to the one end of said housing, inserting a refractory material into the gap between said tuyere housing and said second tuyere, and applying a refractory material to the refractory lining of said vessel and in surrounding relation to the inner end of the tuyere housing to substantially reestablish the original thickness of said lining.

* * * * *